US010170258B2

(12) United States Patent
Fulcheri

(10) Patent No.: US 10,170,258 B2
(45) Date of Patent: Jan. 1, 2019

(54) METHOD FOR CONTROLLING A CHANGE OF OPERATING STATE OF AN ELECTROMECHANICAL COMPONENT AND CORRESPONDING DEVICE

(71) Applicant: STMICROELECTRONICS (ROUSSET) SAS, Rousset (FR)

(72) Inventor: Patrick Fulcheri, Biot (FR)

(73) Assignee: STMicroelectronics (Rousset) SAS, Rousset (FR)

( * ) Notice: Subject to any disclaimer, the term of this patent is extended or adjusted under 35 U.S.C. 154(b) by 426 days.

(21) Appl. No.: 14/960,546

(22) Filed: Dec. 7, 2015

(65) Prior Publication Data

US 2016/0336132 A1 Nov. 17, 2016

(30) Foreign Application Priority Data

May 13, 2015 (FR) ..... 15 54326

(51) Int. Cl.
*H01H 47/32* (2006.01)

(52) U.S. Cl.
CPC ..... *H01H 47/32* (2013.01); *H01H 47/325* (2013.01)

(58) Field of Classification Search
CPC ..... H01H 47/22; H01H 47/32; H01H 47/04; H01H 47/325
USPC ..... 361/160
See application file for complete search history.

(56) References Cited

U.S. PATENT DOCUMENTS

| | | | | |
|---|---|---|---|---|
| 7,035,728 | B2 | 4/2006 | Manzone et al. | |
| 7,036,469 | B2 * | 5/2006 | Degner | F01L 9/04 123/90.11 |
| 2008/0035870 | A1 | 2/2008 | Wygnanski et al. | |
| 2011/0241629 | A1 | 10/2011 | Jordan | |
| 2013/0293202 | A1 | 11/2013 | Utsunomiya et al. | |
| 2014/0110508 | A1 | 4/2014 | Dames et al. | |
| 2015/0162154 | A1 | 6/2015 | Lueck et al. | |

FOREIGN PATENT DOCUMENTS

| | | | |
|---|---|---|---|
| CN | 101523713 | A | 9/2009 |
| CN | 102094839 | A | 6/2011 |
| CN | 102460922 | A | 5/2012 |
| CN | 102969784 | A | 3/2013 |
| CN | 103683955 | A | 3/2014 |

(Continued)

*Primary Examiner* — Dharti H Patel
(74) *Attorney, Agent, or Firm* — Slater Matsil, LLP

(57) ABSTRACT

A method is for controlling a change of an electromechanical component between a first operating state and a second operating state. The method may include changing from the first operating state to the second operating state by generating a first current flowing through the electromechanical component, prior to the generation of the first current, charging a capacitor, and simultaneously with the generation of the first current, partial discharging the capacitor through the electromechanical component to cause an additional current to flow in the electromechanical component, the additional current being added to the first current. The method may include changing from the second operating state to the first operating state by generating a second current flowing in a direction opposite to the first current in the electromechanical component, and prior to the flowing of the second current, discharging the capacitor.

25 Claims, 4 Drawing Sheets

(56) References Cited

FOREIGN PATENT DOCUMENTS

| | | | |
|---|---|---|---|
| CN | 103733517 | A | 4/2014 |
| CN | 103872956 | A | 6/2014 |
| CN | 106160063 | A | 11/2016 |
| DE | 102012107953 | B3 | 2/2014 |
| EP | 1536122 | A2 | 6/2005 |

* cited by examiner

METHOD FOR CONTROLLING A CHANGE OF OPERATING STATE OF AN ELECTROMECHANICAL COMPONENT AND CORRESPONDING DEVICE

RELATED APPLICATION

This application is based upon prior filed copending French Application No. 1554326 filed May 13, 2015, the entire subject matter of which is incorporated herein by reference in its entirety.

TECHNICAL FIELD

The present application relates to control of an electromechanical component, and more particularly, to control of a change of the component from a first operating state to a second operating state.

BACKGROUND

Typically, an electromechanical component comprises an inductive element, such as a coil, coupled between two transistor half-bridges powered by a direct current (DC) power supply source, making it possible to cause a current to flow in the coil in one direction or the other depending on whether it is desired to make the component change from its first operating state to its second operating state or vice-versa, for example, depending on whether it is desired to activate the relay or to deactivate it. In general, one of the currents, for example, the activation current, generated by the power supply source is higher than the other, for example, the deactivation current.

The control of an electromechanical component comprising a coil across two transistor half-bridges generally necessitates a relatively high power, for example, of the order of 220 mW for a small sized bistable relay. Moreover, when a low voltage power supply source is used, it is necessary to have a power supply source, for example, a battery, having a low internal resistance as well as transistors having a low internal resistance in the conducting state (i.e. the "ON" state). Moreover, as the battery becomes smaller, its internal resistance may become increasingly significant.

SUMMARY

Generally speaking, a method is for controlling a change of an electromechanical component between a first operating state and a second operating state. The method may include changing from the first operating state to the second operating state by at least generating a first current flowing through the electromechanical component, the first current being generated by a DC power supply and being greater than a second current, prior to the generation of the first current, charging a capacitor, and simultaneously with the generation of the first current, at least partial discharging the capacitor through the electromechanical component to cause an additional current to flow in the electromechanical component, the additional current being added to the first current. The method may include changing from the second operating state to the first operating state by at least generating the second current with the DC power supply and flowing in a direction opposite to the first current in the electromechanical component, and prior to the flowing of the second current, discharging the capacitor.

DETAILED DESCRIPTION

Figure 1:
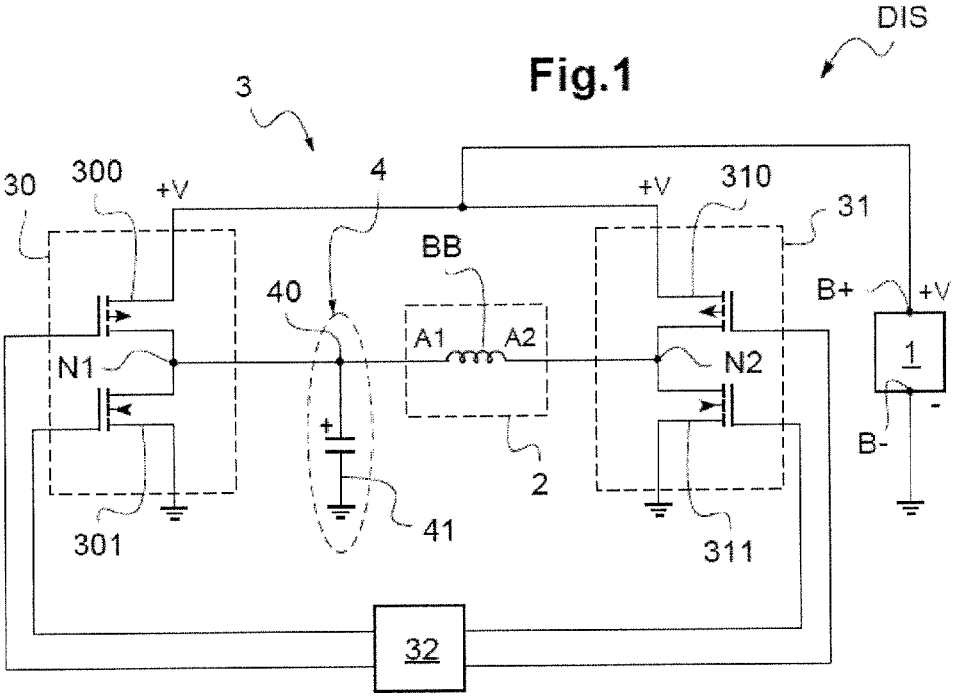
FIG. 1 is a schematic circuit diagram of an electronic device, according to the preset disclosure.

At present for low consumption applications using low voltage power supply sources, one approach may comprise permanently coupling onto the battery a capacitor forming an energy store. However, such capacitors, generally of low cost and having a value of several hundred microfarads, may exhibit significant leakages resulting in permanent current losses. Another approach may include using batteries having a low internal resistance. However, such batteries may be expensive or are larger. Another approach may include using more costly half-bridges in order to lower their internal resistance in the ON state.

The present disclosure may provide efficient control of the change of an electromechanical component from one operating state to another, even using small-sized DC power supply sources having significant internal resistances and/or transistor half-bridges also having significant internal resistances in the ON state. According to an embodiment, a method includes coupling a capacitor on the side of the half-bridge carrying the highest current in order to cause the electromechanical component to change from one of these operating states to the other, for example, during the activation of a relay, and charging this capacitor before causing the current to flow in the coil of the relay and then to discharge this capacitor through the coil in such a way as to generate an additional current which will be added to the current generated by the dc power supply source.

Thus, a method is for controlling the change of an electromechanical component from a first operating state to a second operating state and vice-versa. The change of the component from its first operating state to its second operating state, for example, the activation of a relay, comprises the flowing in an inductive element of the component of a first current generated by a dc power supply and higher than a second current generated by the dc power supply and flowing in the opposite direction in the inductive element during the change from the second operating state to the first operating state, for example, during the deactivation of the relay. The change from the first operating state to the second operating state comprises, prior to the flowing of the first current, a charging of a capacitor and then, simultaneously with the generation of the first current, a discharging of the capacitor through the inductive element in such a way as to cause to flow in the inductive element an additional current which is added to the first current.

Moreover, the change from the second operating state to the first operating state comprises, prior to the flowing of the second current, a discharging of the capacitor. Thus, the presence of this capacitor, which makes it possible, at least at the start of the activation of the electromechanical component, to cause an additional current to flow in the coil of the electromechanical component, allows the use of small sized and inexpensive batteries. Moreover, because of the presence of this additional current generated by the capacitor, the side of the half-bridge carrying the highest current can be "weak", that is to say it can have a significant resistance in the ON state, which allows the use of low cost components or even fewer components since it is even possible to use the output port of a conventional microcontroller in certain cases.

According to one embodiment, the method can comprise an additional phase of discharging the capacitor after each change of the electromechanical component from one of its two states to its other state. Such a phase thus allows a time saving when changing from the second state to the first operating state (typically during the deactivation of the relay). Moreover, the fact of providing this additional phase during the change from the first operating state (typically during the activation of the relay) makes it possible to have symmetrical behavior from one cycle to the other, i.e. during the activation and during the deactivation.

According to another aspect, an electronic device may include a DC power supply source capable of generating a first current and a second current lower than the first current, and an electromechanical component comprising an inductive element and having a first operating state and a second operating state. The electronic device may include a control module powered by the power supply source and having a first control terminal and a second control terminal respectively coupled to the two terminals of the inductive element and capable of adopting a first configuration allowing a flow of the first current from the first control terminal to the second control terminal in order to cause the component to change from its first operating state to its second operating state and a second configuration allowing a flow of the second current from the second control terminal to the first control terminal in order to cause the component to change from its second operating state to its first operating state. The control module may also comprise a capacitor.

The control module is furthermore capable of adopting, prior to the first configuration, an initial first configuration allowing a charging of the capacitor and then allowing, during its first configuration a discharge, at least partial, of the capacitor through the inductive element in order to cause an additional current to flow in it which is added to the first current. Also, the control module is furthermore capable of adopting, prior to the second configuration, an initial second configuration allowing a discharging of the capacitor.

Additionally, the DC power supply source comprises a positive terminal and a negative terminal, the capacitor is coupled between the first control terminal and the negative terminal. The control module may include a first switch and a second switch coupled in series between the positive terminal and the negative terminal of the voltage source and having a first common node forming the first control terminal, a third switch and a fourth switch coupled in series between the positive terminal and the negative terminal of the voltage source and having a second common node forming the second control terminal, and control means or a controller. The controller may be configured to close the first switch and open the other switches in order to place the control module in its initial first position and then to close the first and fourth switches and open the other switches in order to place the control module in its first configuration, and close the second switch and open the other switches in order to place the control module in its initial second configuration and then to close the second and third switches and open the other switches in order to place the control module in its second configuration.

The control module is furthermore capable of adopting a final configuration, after the first configuration and the second configuration, allowing a discharging of the capacitor. Thus, the controller is, for example, configured to close the second switch and open the other switches in order to place the control module in its final configuration.

In FIG. 1, the reference DIS denotes an electronic device comprising a DC power supply source 1, for example, a battery or cells, rechargeable or not, delivering an off-load voltage +V. The reference numeral 2 denotes an electromechanical component, for example, a relay, comprising an inductive element BB such as a coil, having two terminals A1 and A2.

The device DIS comprises a control module 3 powered by the power supply source 1 and having a first control terminal N1 and a second control terminal N2 respectively coupled to the two terminals A1 and A2 of the inductive element BB. In this example of embodiment, the control module 3 comprises a first transistor half-bridge 30 comprising a first switch 300, in this case a PMOS transistor, and a second switch 301, in this case an NMOS transistor, coupled in series between the positive terminal B+ and the negative terminal B− (the ground) of the voltage source 1. The first control terminal N1 is formed by the two coupled drains of the two transistors 300 and 301.

The control module 3 comprises a second transistor half-bridge 31 in this case comprising a third switch 310, for example, a PMOS transistor, and a fourth switch 311, for example, an NMOS transistor, coupled in series between the positive terminal B+ and the negative terminal B− of the DC power supply source 1. The second control terminal N2 is formed by the two coupled drains of the transistors 310 and 311.

The four transistors 300, 301, 310 and 311 are controlled on their respective gates by control signals delivered by controller 32, which can, for example, be embodied in a software manner within a microcontroller. In addition to the components that have just been described, the device DIS also comprises a capacitor 4 having a first terminal 40 coupled to the first control terminal N1 as well as to the first terminal A1 of the coil BB and a second terminal 41 coupled to the negative terminal B− of the power supply source.

As will be seen in more detail below, the control module 3 and the capacitor 4 are intended to control the change of the electromechanical component 2 from a first operating state to a second operating state. When this electromechanical component is, for example, a relay, the first operating state is, for example, a deactivated state and the second operating state is then an activated state.

The change from the first operating state to the second operating state consequently corresponds to the activation of the relay while the change from the second operating state to the first operating state corresponds to the deactivation of the relay. The change of the electromechanical component 2 from one operating state to another comprises the flowing of a current in the inductive element BB. Moreover, one of the currents is generally higher than the other.

This is notably the case when the electromechanical component is a bistable relay. In fact, the current necessary for the activation of the relay is generally higher than that necessary for its deactivation since, during the activation, the magnetic gap is greater, and the permanent magnetic flux is weak whereas, during the deactivation, the magnetic gap is zero because the relay is engaged and it is only necessary to cancel the permanent magnetic flux in order to disengage the relay, i.e. to deactivate it.

In the example described here, the activation of the relay will result in a current flowing in the coil BB from the terminal A1 to the terminal A2 while the deactivation will result in a current flowing in the coil from the terminal A2 to the terminal A1. Also, since the activation current is higher than the deactivation current, the capacitor 4 is coupled at the level of the first control terminal N1 that is to say on the side of the half-bridge 30 intended to carry the highest current.

Figure 2:
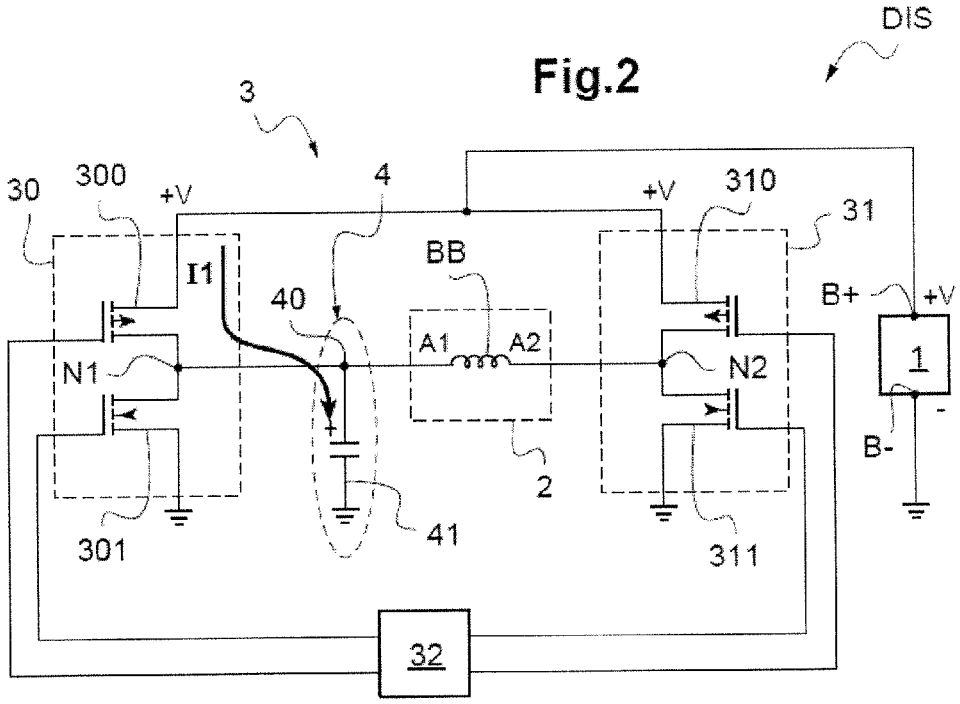
FIG. 2 is a schematic circuit diagram of the electronic device of FIG. 1 in an initial first configuration.
Figure 3:
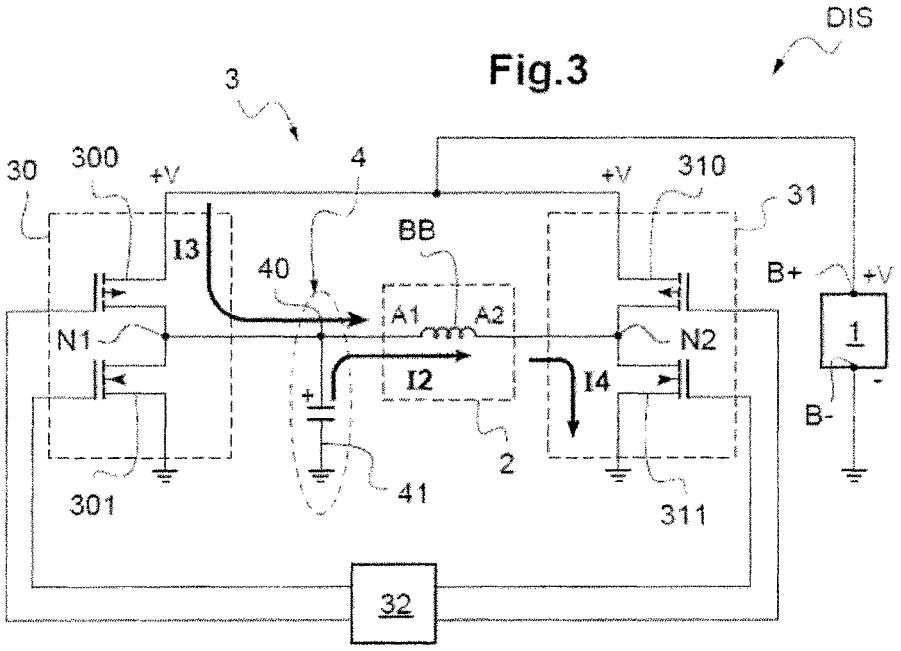
FIG. 3 is a schematic circuit diagram of the electronic device of FIG. 1 in a first configuration.
Figure 4:
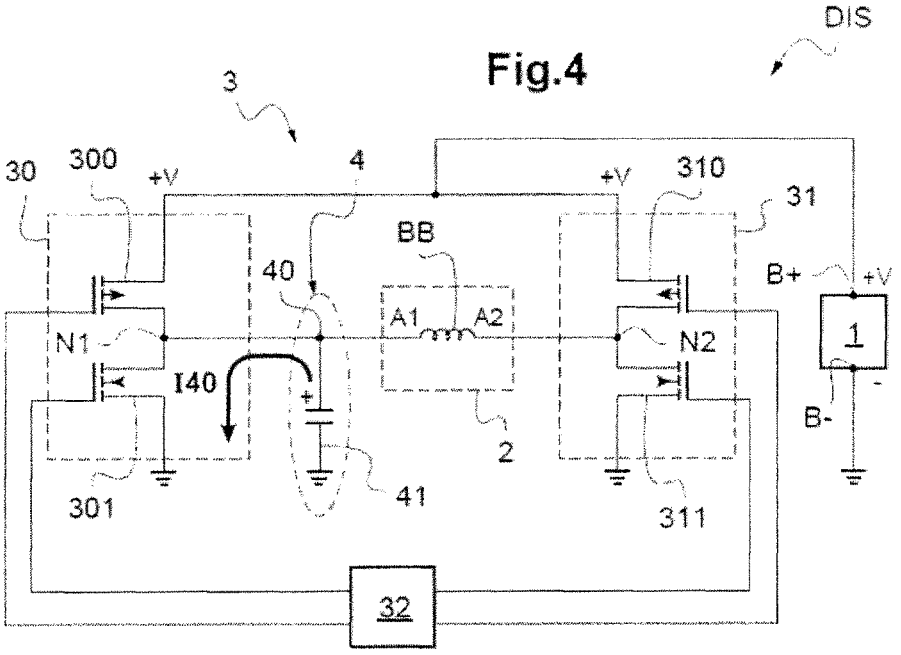
FIG. 4 is a schematic circuit diagram of the electronic device of FIG. 1 in an activation cycle.

Reference will now more particularly be made to FIGS. 2 to 7 in order to illustrate an example of operation of the device DIS shown in FIG. 1. FIGS. 2 to 4 relate to the activation of the electromechanical relay 2, i.e. to the change of the relay from its first operating state (deactivated state) to its second operating state (activated state).

Referring more particularly now to FIG. 2, it can be seen that the control module 3 adopts an initial first configuration in which the first switch 300 is closed (transistor ON) while the other switches 301, 310 and 311 are open (transistors OFF). This initial first configuration allows a charging of the capacitor 4 by a current I1 delivered by the DC power supply source 1.

Those skilled in the art will know how to adjust the time necessary for placing the control module in this initial first configuration in order to charge the capacitor. This of course depends on the size of the capacitor. Thus, for a capacitor having a capacitive value of between about ten microfarads and a few hundred microfarads, the charging time can be of the order of a few milliseconds to several tens of milliseconds.

Then, as shown in FIG. 3, the control module adopts a first configuration in which the first switch 300 and the fourth switch 311 are closed and the other switches 301 and 310 are open. In this first configuration, the battery 1 forms, with its internal resistance and the internal resistance of the transistor 300 in the ON state, a first current source, and the capacitor 4 which has been charged with the off-load voltage +V of the battery, forms, with its low internal resistance, a second current source. These two current sources are in parallel.

Moreover, at the start, the current source formed by the capacitor 4 and its low impedance is preponderant in comparison with the current source formed by the battery, its internal resistance and the internal resistance of the transistor 300. Because of this, the capacitor 4 can discharge through the coil BB in order to supply an additional current I2 which will be added to the current I3 delivered by the battery 1. The resultant current I4 having passed through the coil BB then discharges to ground via the transistor 311.

The capacitor 4 discharges to the point of equilibrium of the voltages and only at that time does the current I3 delivered by the battery flow in the coil BB. Thus, the capacitor 4 has allowed, during the activation of the relay, the supply of an additional current at the start, which makes it possible to overcome the possible negative effects due to a high internal resistance of the battery and/or the transistor 300.

Referring now to FIG. 4, it can be seen that the activation cycle preferably ends with a discharging of the capacitor 4 to ground (discharge current I40). For this purpose, the control module 3 adopts a final configuration allowing the discharge of the capacitor 4. In this final configuration, the controller 32 closes the second switch 301 and open the other switches 300, 310 and 311.

Here again, the switch 301 is left closed for enough time to allow an effective discharge of the capacitor 4. By way of indication, a few milliseconds may be necessary. Then, the controller 32 places the control module in a state of rest in which all of the switches 300, 301, 310 and 311 are open (transistors OFF).

Figure 5:
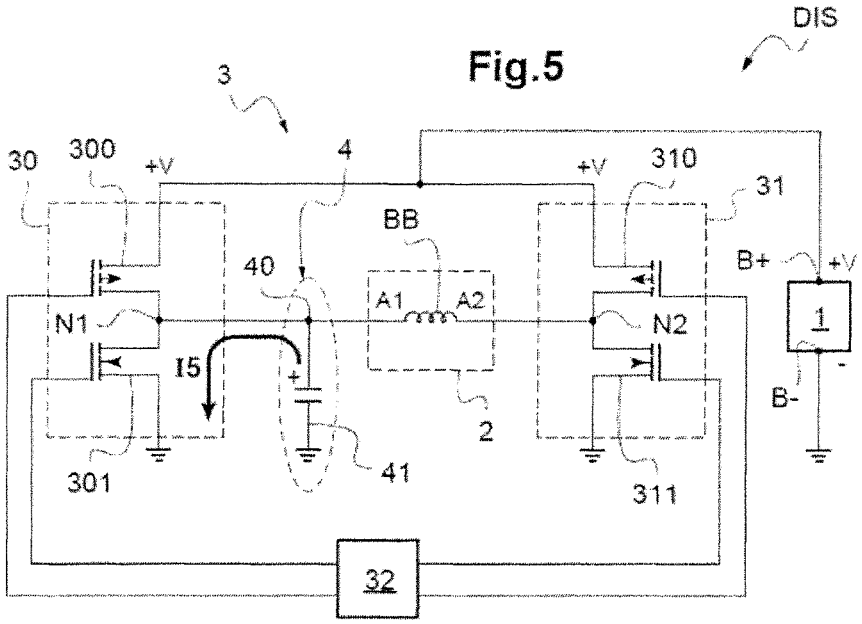
FIG. 5 is a schematic circuit diagram of the electronic device of FIG. 1 in an initial second configuration.
Figure 6:
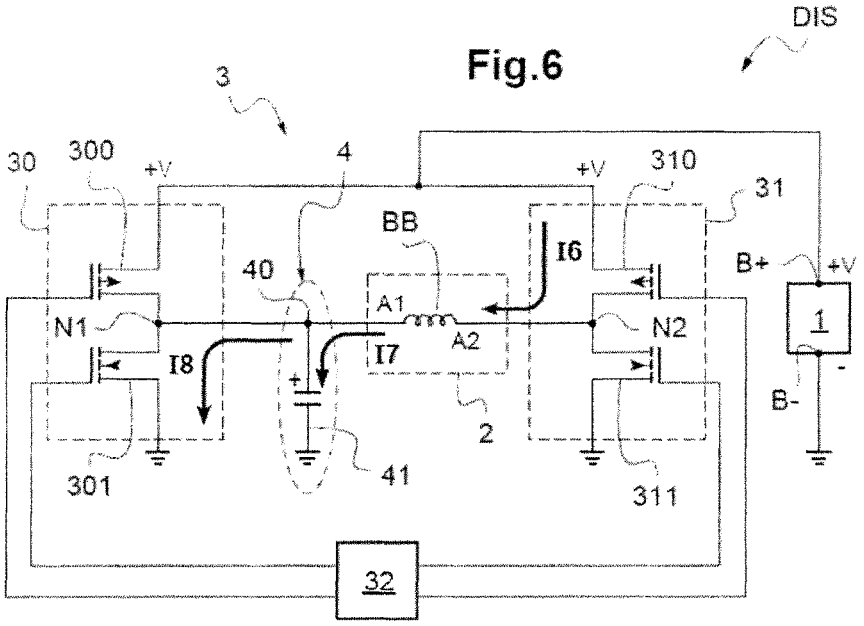
FIG. 6 is a schematic circuit diagram of the electronic device of FIG. 1 in a second configuration.
Figure 7:
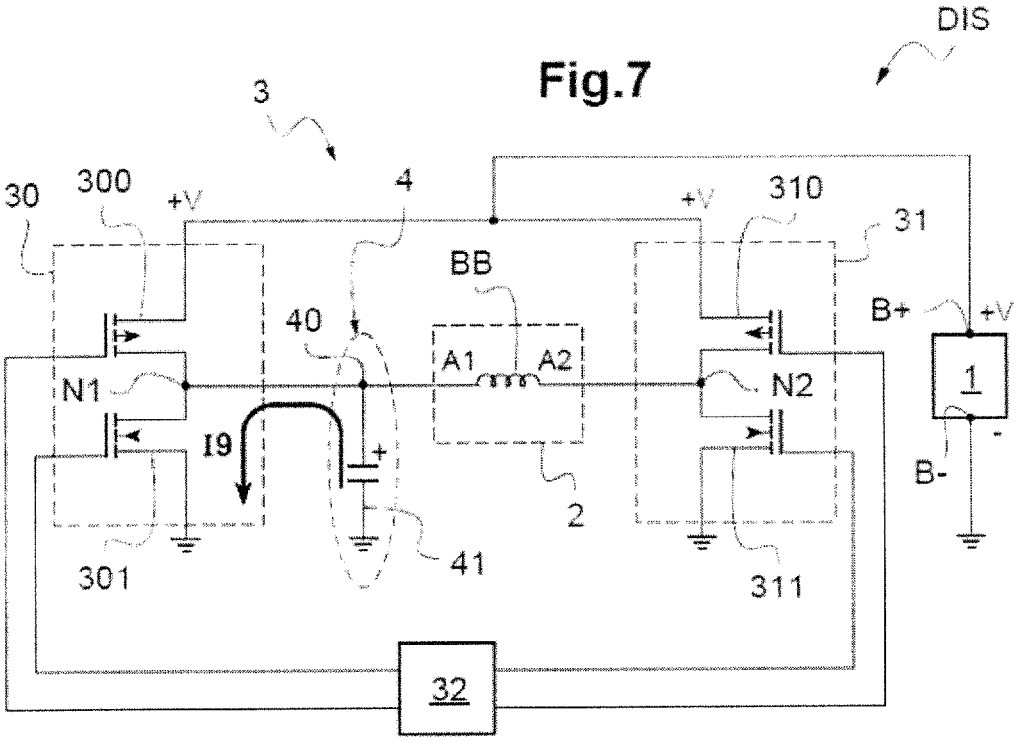
FIG. 7 is a schematic circuit diagram of the electronic device of FIG. 1 in a final configuration.

Reference is now made to FIGS. 5 to 7 in order to illustrate an example of operation of the device DIS during the deactivation of the relay. For this deactivation, the controller 32 places the control module in an initial second configuration illustrated in FIG. 5, in which it controls the second switch 301 in such a way as to make it conductive in order to allow a discharge of the capacitor 4 (discharge current I5). In fact, this makes it possible to ensure that the capacitor 4 is empty before proceeding with the actual deactivation of the relay.

Then, as shown in FIG. 6, the controller 32 places the control module in a second configuration in which the third switch 310 and the second switch 301 are closed while the other switches 300 and 311 are open. Because of this, a current I6 delivered by the power supply source 1 flows in the coil BB from the terminal A2 to the terminal A1 and this current I6 then subdivides at the beginning of the deactivation phase into a current I7 charging the capacitor 4 and a current I8 discharging to ground.

The capacitor 4 will be charged up to the point of equilibrium of voltages and at that moment the current I7 is cancelled out and only the current I8 remains. Then, as shown in FIG. 7, the controller 32 again places the control module 3 in its final configuration in which the transistor 301 is ON, in order to discharge the capacitor 4 via the discharge current I9. Then, the controller again places the control module in its state of rest in which all of the switches are open.

The size of the capacitor 4 depends on the characteristics of the electromechanical component. This being so, a capacitor having the capacitive value mentioned above (i.e. a few tens of microfarads to a few hundred microfarads) makes it possible to activate or to deactivate a bistable relay having a power rating of a few tens of milliwatts.

It will be noted here that the capacitor 4 does not consume power outside of the active phases of activation and of deactivation. In fact, outside of these phases, when the control module is in the state of rest, the capacitor 4 is electrically isolated from the battery 1. Consequently, the possible leakages of the capacitor have no importance, which makes it possible to use a low-cost capacitor.

Moreover, since the capacitor 4 makes it possible to have a half-bridge 30 having a reduced internal resistance in the ON state, it would be entirely possible to use the transistors integrated in the output port of a microcontroller for the transistors 300 and 301. However, in the case where high power is necessary for the activation and deactivation of the relay, it would of course still be necessary to provide transistors 300 and 301 of appropriate size and which would then be outside of the microcontroller 32.

That which is claimed is:

1. A method for controlling an electromechanical component, the method comprising:

transitioning the electromechanical component from a first operating state to a second operating state by:

charging a capacitor coupled to a first terminal of an inductive element of the electromechanical component, and after charging the capacitor, generating a first current from a power supply while simultaneously generating a second current by partially discharging the capacitor, the first current and the second current forming a third current flowing through the inductive element from the first terminal of the inductive element to a second terminal of the inductive element;

maintaining the electromechanically component in the second operating state by preventing current from flowing through the inductive element;

transitioning the electromechanical component from the second operating state to the first operating state by:

discharging the capacitor, and after discharging the capacitor, generating a fourth current from the power supply, the fourth current flowing through the inductive element from the second terminal of the inductive element to the first terminal of the inductive element; and maintaining the electromechanically component in the first operating state by preventing current from flowing through the inductive element.

2. The method of claim 1, wherein the transitioning the electromechanical component from the first operating state to the second operating state further comprises discharging the capacitor after generating the first and second currents.

3. The method of claim 2, wherein discharging the capacitor after generating the first and second currents comprises discharging the capacitor through a first half-bridge coupled to the first terminal of the inductive element.

4. The method of claim 3, wherein charging the capacitor comprises turning on a high-side switch of the first half-bridge and turning off a low-side switch of the first half-bridge, and wherein discharging the capacitor comprises turning on the low-side switch and turning off the high-side switch.

5. The method of claim 4, wherein generating the first and second currents comprises:

turning on the high-side switch of the first half-bridge;

turning off the low-side switch of the first half-bridge;

turning off a high-side switch of a second half-bridge, the second half-bridge being coupled to the second terminal of the inductive element; and turning on a low-side switch of the second half-bridge.

6. The method of claim 5, wherein maintaining the electromechanically component in the first operating state or in the second operating state comprises turning off the high-side switch and the low-side switch of the first half-bridge, and turning off the high-side switch and the low-side switch of the second half-bridge.

7. The method of claim 1, wherein the third current is higher than the fourth current.

8. The method of claim 1, wherein the power supply comprises a positive terminal and a negative terminal, the capacitor being coupled between the first terminal of the inductive element and the negative terminal of the power supply.

9. A device comprising:

a first half-bridge comprising:

an output terminal configured to be coupled to a capacitor and to a first terminal of an inductive element of an electromechanical component, a first supply terminal configured to be coupled to a positive terminal of a direct-current (DC) battery, and a second supply terminal configured to be coupled to a negative terminal of the DC battery;

a second half-bridge comprising:

an output terminal configured to be coupled to a second terminal of the inductive element, a first supply terminal configured to be coupled to the positive terminal of the DC battery, and a second supply terminal configured to be coupled to the negative terminal of the DC battery; and a controller configured to:

transition the electromechanical component from a first operating state to a second operating state by:

charging the capacitor, and after charging the capacitor, generating a first current from the DC battery while simultaneously generating a second current by partially discharging the capacitor, the first current and the second current forming a third current flowing through the inductive element from the first terminal of the inductive element to the second terminal of the inductive element;

maintain the electromechanically component in the second operating state by preventing current from flowing through the inductive element;

transition the electromechanical component from the second operating state to the first operating state by:

discharging the capacitor, and after discharging the capacitor, generating a fourth current from the DC battery, the fourth current flowing through the inductive element from the second terminal of the inductive element to the first terminal of the inductive element; and maintaining the electromechanically component in the first operating state by preventing current from flowing through the inductive element.

10. The device of claim 9, wherein the controller is further configured to discharge the capacitor after generating the first and second currents during the transitioning of the electromechanical component from the first operating state to the second operating state.

11. The device of claim 9, wherein:

the first half-bridge comprises a first switch coupled between the first supply terminal of the first half-bridge and the output of the first half-bridge, and a second switch coupled between the second supply terminal of the first half-bridge and the output of the first half-bridge;

the second half-bridge comprises a third switch coupled between the first supply terminal of the second half-bridge and the output of the second half-bridge, and a fourth switch coupled between the second supply terminal of the second half-bridge and the output of the second half-bridge; and the controller is configured to maintain the electromechanical component in the first operating state or in the second operating state by turning off the first, second, third and fourth switches.

12. The device of claim 11, wherein the controller is further configured to discharge the capacitor after generating the first and second currents during the transitioning of the electromechanical component from the first operating state to the second operating state via the second switch.

13. The device of claim 11, wherein he controller is configured to charge the capacitor by turning on the first switch and turning off the second, third and fourth switches.

14. The device of claim 11, wherein the controller is configured to generate the first and second current by turning the first and fourth switches on and turning the second and fourth switches off.

15. The device of claim 11, wherein the first, second, third and fourth switches are metal-oxide semiconductor (MOS) transistors.

16. The device of claim 11, wherein the first and third switches are transistors of the n-type and wherein the second and fourth switches are transistors of the p-type.

17. The device of claim 9, further comprising the capacitor, the DC battery and the electromechanical component.

18. The device of claim 17, wherein electromechanical component is a bistatic relay and the inductive element is a coil of the bistatic relay.

19. The device of claim 17, wherein the capacitor is coupled between the output terminal of the first half-bridge and the negative terminal of the DC battery.

20. The device of claim 9, wherein the third current is higher than the fourth current.

21. An electronic device comprising:

a first output terminal configured to be coupled to a capacitor and to a first terminal of an inductive element of an electromechanical component;

a second output terminal configured to be coupled to a second terminal of the inductive element;

a first supply terminal configured to be coupled to a positive terminal of a power supply;

a second supply terminal configured to be coupled to a negative terminal of the power supply; and a controller configured to:

transition the electromechanical component from a first operating state to a second operating state by:

charging the capacitor, and after charging the capacitor, generating a first current from the power supply while simultaneously generating a second current by partially discharging the capacitor, the first current and the second current forming a third current flowing through the inductive element from the first terminal of the inductive element to the second terminal of the inductive element;

maintain the electromechanically component in the second operating state by preventing current from flowing through the inductive element;

transition the electromechanical component from the second operating state to the first operating state by:

discharging the capacitor, and after discharging the capacitor, generating a fourth current from the power supply, the fourth current flowing through the inductive element from the second terminal of the inductive element to the first terminal of the inductive element; and maintaining the electromechanically component in the first operating state by preventing current from flowing through the inductive element.

22. The electronic device of claim 21, further comprising the capacitor, the power supply and the electromechanical component, wherein the electromechanical component comprises a bistatic relay having a coil, and wherein the inductive element is the coil of the bistatic relay.

23. A method comprising:

transitioning a bistatic relay from a first operating state to a second operating state by:

charging a capacitor coupled to a first terminal of a coil of the bistatic relay by turning on a high-side transistor of a first half-bridge and turning off a low-side transistor of the first half-bridge, the first half-bridge having an output coupled to the capacitor and to the first terminal of the coil, and after charging the capacitor, generating a first current from a power supply via the high-side transistor of the first half-bridge while simultaneously generating a second current by partially discharging the capacitor, the first current and the second current forming a third current flowing through the coil from the first terminal of the coil to a second terminal of the coil;

maintaining the bistatic relay in the second operating state by turning off the high-side and low-side transistors of the first half-bridge and by turning off a high-side and low-side transistors of a second half-bridge, the second half-bridge having an output coupled to the second terminal of the coil;

transitioning the bistatic relay from the second operating state to the first operating state by:

discharging the capacitor, and after discharging the capacitor, generating a fourth current from the power supply via the high-side transistor of the second half-bridge, the fourth current flowing through the coil from the second terminal of the coil to the first terminal of the coil; and maintaining the bistatic relay in the first operating state by turning off the high-side and low-side transistors of the first half-bridge and by turning off the high-side and low-side transistors of the second half-bridge.

24. The method of claim 23, wherein the third current is higher than the fourth current.

25. The method of claim 23, wherein generating the first and second currents comprises:

turning on the high-side transistor of the first half-bridge and the low-side transistor of the second half-bridge; and turning off the low-side transistor of the first half-bridge and the high-side transistor of the second half-bridge.

* * * * *